US009422784B2

(12) United States Patent
Shah

(10) Patent No.: US 9,422,784 B2
(45) Date of Patent: Aug. 23, 2016

(54) SNUBBING STACK

(71) Applicant: Javed Shah, Edmonton (CA)

(72) Inventor: Javed Shah, Edmonton (CA)

( * ) Notice: Subject to any disclaimer, the term of this patent is extended or adjusted under 35 U.S.C. 154(b) by 308 days.

(21) Appl. No.: 14/079,494

(22) Filed: Nov. 13, 2013

(65) Prior Publication Data

US 2014/0209299 A1 Jul. 31, 2014

Related U.S. Application Data

(60) Provisional application No. 61/725,706, filed on Nov. 13, 2012.

(51) Int. Cl.
*E21B 33/068* (2006.01)
*E21B 19/00* (2006.01)

(52) U.S. Cl.
CPC ..... *E21B 33/068* (2013.01); *E21B 19/00* (2013.01)

(58) Field of Classification Search
CPC ..... E21B 33/068; E21B 19/00; E21B 19/08; E21B 33/076
USPC ..... 166/77.53, 85.1
See application file for complete search history.

(56) References Cited

U.S. PATENT DOCUMENTS

| | | | | | |
|---|---|---|---|---|---|
| 5,568,837 | A * | 10/1996 | Funk | E21B 19/00 | 166/383 |
| 5,988,274 | A * | 11/1999 | Funk | E21B 19/08 | 166/77.4 |
| 6,321,848 | B1 * | 11/2001 | Funk | E21B 23/08 | 166/383 |
| 7,584,798 | B2 * | 9/2009 | Dallas | E21B 33/068 | 166/383 |
| 7,735,564 | B2 * | 6/2010 | Guerrero | E21B 19/00 | 166/379 |
| 2008/0060846 | A1 * | 3/2008 | Belcher | E21B 17/042 | 175/25 |
| 2008/0302530 | A1 * | 12/2008 | Shampine | E21B 33/068 | 166/250.08 |
| 2011/0048734 | A1 * | 3/2011 | Johnson | E21B 33/068 | 166/377 |
| 2013/0192834 | A1 * | 8/2013 | Schneider | E21B 36/003 | 166/302 |

* cited by examiner

*Primary Examiner* — Michael Wills, III
(74) *Attorney, Agent, or Firm* — Christensen O'Connor Johnson Kindness PLLC

(57) ABSTRACT

A snubbing apparatus for a wellhead has a snubbing stack with a upper sealing element and a lower sealing element that seal between the elongate string and the snubbing stack. A string driver carried by the snubbing stack manipulates the elongate string through the upper and lower sealing elements. There is a source of inert liquid connected to the snubbing stack between the upper sealing element and the lower sealing element. A pressure sensor is connected to sense the pressure below the lower sealing element and is connected to provide a pressure signal to the source of inert liquid. The source of inert liquid is configured to pressurize the snubbing stack between the upper sealing element and the lower sealing element in response to the pressure signal.

21 Claims, 1 Drawing Sheet

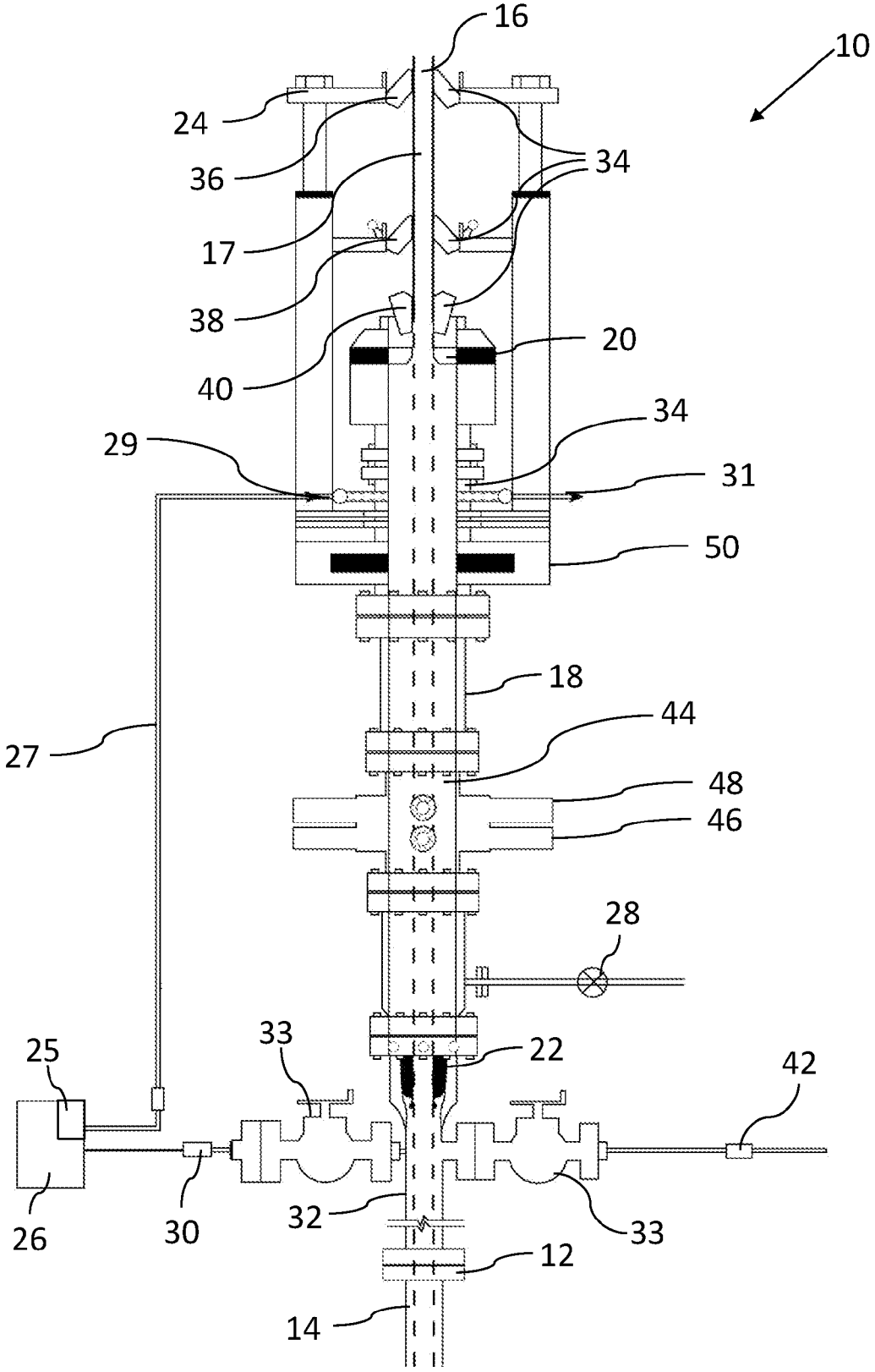
16
10
24
36
34
17
38
20
40
34
29
31
50
18
44
27
48
46
28
25
33
22
42
26
30
32
33
12
14

SNUBBING STACK

TECHNICAL FIELD

This relates to a snubbing stack used to snub into or out of a pressurized wellhead.

BACKGROUND

When it is necessary to inject or remove a tubing string or other elongate string from a pressurized wellhead, a snubber is used. The wellhead will generally be sealed, such as by a blow-out preventer, and the snubber will either push or pull the tubing through the seal. As such, the snubber allows the pressure to be contained within the wellhead.

SUMMARY

There is provided a snubbing apparatus for a wellbore having a wellhead, an elongate string being inserted into the wellbore through the wellhead. The snubbing apparatus comprises a snubbing stack having a upper sealing element and a lower sealing element, wherein, in operation, the upper and lower sealing elements seal between the elongate string and the snubbing stack. A string driver is carried by the snubbing stack, the string driver manipulating the elongate string through the upper sealing element and the lower sealing element. A source of inert liquid is connected to the snubbing stack between the upper sealing element and the lower sealing element. A pressure sensor is connected to sense the pressure below the lower sealing element and connected to provide a pressure signal to the source of inert liquid, the source of inert liquid being configured to pressurize the snubbing stack between the upper sealing element and the lower sealing element in response to the pressure signal.

According to an aspect, the source of inert liquid may be configured to equalize the pressure between the upper sealing element and the lower sealing element to the pressure below the lower sealing element.

According to an aspect, the snubbing apparatus may further comprise a bleed off valve connected to the snubbing stack between the upper sealing element and the lower sealing element.

According to an aspect, the snubbing stack may comprise a tubing spool that extends below the lower sealing element, and the pressure sensor may be connected to the tubing spool.

According to an aspect, the tubing driver may be snubbing slips.

According to an aspect, the upper sealing element may be an annular blowout preventer.

According to an aspect, the lower sealing element may be a resilient sealing element.

According to an aspect, the lower sealing element may be within a tubing spool.

According to an aspect, there may be a bleed off valve connected below the lower sealing element.

According to an aspect, the source of inert liquid is a liquid pump.

According to an aspect, the inert liquid may be glycol.

According to another aspect, there is provided a method of snubbing an elongate string into a wellbore having a wellhead, the method comprising the steps of: providing a snubbing stack having a upper sealing element and a lower sealing element; inserting the elongate string into the snubbing stack such that the top and lower sealing elements seal between the elongate string and the snubbing stack; driving the elongate string to move through the upper sealing element and the lower sealing element; sensing a wellhead pressure below the lower sealing element; injecting an inert fluid into the snubbing stack; and pressurizing the inert fluid within the snubbing stack based on the wellhead pressure.

According to an aspect, pressurizing the inert fluid may comprise equalizing the pressure to the wellhead pressure.

According to an aspect, injecting an inert fluid into the snubbing jack may further comprise bleeding off fluid within the snubbing stack as the inert fluid is injected.

According to an aspect, the snubbing stack may comprise a spool that extends below the lower sealing element and the pressure is measured by a pressure sensor connected to the spool.

According to an aspect, driving the elongate string may comprise using snubbing slips.

According to an aspect, the upper sealing element may be an annular blowout preventer.

According to an aspect, the lower sealing element may be a resilient sealing element.

According to an aspect, the lower sealing element may be within a spool.

According to an aspect, the inert liquid may be pressurized by a liquid pump connected to a source of inert liquid.

According to an aspect, the inert liquid may be glycol.

Other aspects will be apparent from the description and drawings below. Each of the described aspects may be combined with other aspects except when mutually exclusive.

BRIEF DESCRIPTION OF THE DRAWINGS

These and other features will become more apparent from the following description in which reference is made to the appended drawings, the drawings are for the purpose of illustration only and are not intended to be in any way limiting, wherein:

FIG. 1 is a side elevation view of a snubbing stack for a pressurized wellhead.

DETAILED DESCRIPTION

A snubbing apparatus generally identified by reference numeral 10 will now be described with reference to FIG. 1.

Structure and Relationship of Parts:

The snubbing apparatus 10 is primarily intended for use when servicing high temperature and/or high pressure wells and is designed to help reduce the risk of fire or explosions. The snubbing apparatus 10 as shown in FIG. 1 is mounted to a wellhead 12 generally is mounted above a casing string 14 that extends into a wellbore below the wellhead 12. An elongate string 16 is inserted into wellhead 12 and casing string 14. As shown, the elongate string 16 is a tubing string. The following will describe the snubbing apparatus in terms of a tubing string 16, although it will be understood that elongate string 16 may also be a rod or other elongate string that may be snubbed as known in the art. Snubbing apparatus 10 has a snubbing stack 18 with an upper sealing element 20 and a lower sealing element 22. The upper sealing element 20 and the lower sealing element 22 seals between the tubing string 16 and the snubbing stack 18. As shown, upper sealing element 20 is an annular blowout preventer, and lower sealing element 22 is a resilient sealing element. An example of a suitable resilient sealing element is a RS-100 Seal produced by Mitey Titan Industries Inc. of Edmonton, Alberta, although other seals may be produced.

It will be understood that other seals as are known in the art may be used for either the top or bottom seals.

The snubbing stack 18 carries a string driver 24, which is used to manipulate tubing string 16 through the upper sealing element 20 and the lower sealing element 22. As shown, tubing driver 24 is snubbing slips 34 used to drive tubing string 16, although it will be understood that different drivers 24 may be used as are known in the art. Snubbing slips 34 as shown include three types of slips 34, specifically, travelling slips 36, stationary slips 38, and heavy slips 40. Travelling slips 36 grip tubing string 16 and move it upwards or downwards. Stationary slips 38 grip the tubing string 16 to prevent movement while travelling slips 36 release tubing string 16 while they are repositioned to grip tubing string 16 to again apply force to move tubing string 16. Heavy slips 40 are generally optional, and are used to bear the weight of tubing string 16 when desirable.

Snubbing stack 18 is designed to be filled with an inert liquid between upper sealing element 20 and lower sealing element 22. Inert fluid is provided by a source of inert liquid 26 connected by a supply line 27 to a port 29. The source of inert liquid 26 is configured to pressurize the liquid within snubbing stack 18 between upper sealing element 20 and lower sealing element 22 relative to the wellbore pressure, which as shown is measured by a pressure sensor below lower sealing element 22. Preferably, the pressure of the liquid is equalized with the pressure in casing string 14. However, sealing element 22 is designed to withstand some pressure, and the pressure within stack 18 may be slightly lower. On the other hand, to ensure no leakage into stack 18 from casing 14, the pressure within stack 18 may be equal to or greater than the pressure in casing 14. The source of inert liquid 26 is, for example, a liquid pump 25. The inert liquid is pressurized by a liquid pump 25 connected to a source of inert liquid 26. The inert liquid provided by the source of inert liquid 26 is preferably glycol, although it will be understood that other types of inert liquid may be used, for example, water. Connected to the snubbing stack 18, there may be a bleed off valve 28 between the upper sealing element 20 and the lower sealing element 22. As shown, bleed off valve 28 is located at the bottom of snubbing stack 18, and is intended to be used to drain any fluid in snubbing stack 18 as the inert liquid is pumped in. There may be a second bleed off valve 31 located at the top of snubbing stack 18. Either or both of these valves 28 and 31 may be used to relieve pressure in snubbing stack 18 between sealing elements 20 and 22.

Pressure sensor 30 is connected below the lower sealing element 22 and provides a pressure signal to the source of inert liquid 26. The source of inert liquid 26 pressurizes the snubbing stack 18 between the upper sealing element 20 and the lower sealing element 22 to the desired pressure relative to the pressure within casing 14. This is preferably done in response to the pressure signal from the pressure sensor 30. Source 26 may be regulated in various ways. For example, there may be a microcontroller that regulates the pressure. There may also be other mechanical or electrical sensors or switches that control source 26 in response to the pressure within casing string 14. Pressure sensor 30 allows for the inert fluid to be added into the cavity 44 between the upper sealing element 20 and the lower sealing element 22, pressurizing the inert fluid within the cavity 44 until the pressure of the inert fluid is equal to the pressure of the wellhead 12. Pressure sensor 30 may attach to snubbing stack 18 below lower sealing element 22. In the depicted example, snubbing stack 18 has a tubing spool 32 below lower sealing element 22 that houses lower sealing element 22 and to which pressure sensor 30 is attached. As can be seen, there is a valve, such as a casing valve 33, between pressure sensor 30 and tubing spool 32. This is optional, but may be useful, for example to isolate pressure sensor 30 if a problem arises. There may also be a casing bleed off valve 42 connected to tubing spool 32 by another casing valve 33. This bleed off valve 42 allows downhole fluid pressure to be relieved below lower sealing element 22.

Snubbing stack 18 may also include other features, such as a blind ram blowout preventer (BOP) 46 and a pipe ram BOP 48 as well as a stripping ram BOP 50. These BOPs are include for safety purposes to ensure safe operation and to allow the operator to control the well in the event of a failure. Stripping ram BOP 50, port 29 and bleed off valve 31 may all be carried by an equalizing spool 52, depending on the preferences of the user.

Operation:

The construction of a well is well known in the art and the downhole assembly will not be discussed in detail. When it is desired to snub a tubing string into or out of a well, snubbing stack 18 is attached to wellhead 12. Snubbing stack 18 may be as shown in FIG. 1, or may be any reasonable variation based on the principles described above. During the process of assembling snubbing stack 18, a rubber insert 22 or other similar sealing element is place in tubing spool 32 in order to form lower sealing element 22. The pressure sensor 30 installed on tubing spool 32 in the drawings connects to a device that can pump the inert liquid 26 inside the snubbing stack 18, such as a skid mounted triplex pump, and this device is attached to the pressure sensor 30.

When placing the snubbing stack 18 with an upper sealing element 20 and a lower sealing element 22, the tubing string 16 will be inserted such that the upper sealing element 20 and the lower sealing element 22 form a seal about tubing string 16 within snubbing stack 18. Once properly installed, downhole pressure will be contained below lower sealing element 22, although snubbing stack 18 may be filled with downhole fluids. Source of inert liquid 26, such as a pump, is then be turned on and glycol or another inert liquid is added to the cavity 44 formed between upper sealing element 20 and lower sealing element 22. Casing bleed off valve 42 may be used to allow any well fluids to be drained out of cavity 44, allowing it to be filled with inert liquid. Source of inert liquid 26 continues to pump liquid until such point as the pressure in this cavity 44 is equal to the pressure in the wellhead 12 below lower sealing element 22 as detected by pressure sensor 30, or matches some other predetermined pressure relationship as described above. The use of glycol or other inert liquid ensures that, in the event of an equipment or seal failure, the inert liquid will be released prior to the wellbore fluids, allowing operators the opportunity to shut in the well or close a BOP. Once properly installed and arranged, tubing string 14 may be snubbed in or out using string driver 24.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A snubbing apparatus for a wellbore having a wellhead, an elongate string being inserted into the wellbore through the wellhead, the snubbing apparatus comprising:

a snubbing stack having an upper sealing element and a lower sealing element, wherein, in operation, the upper and lower sealing elements seal between the elongate string and the snubbing stack, the lower sealing element sealing the snubbing stack against a wellbore pressure below the lower sealing element;

a string driver carried by the snubbing stack, the string driver manipulating the elongate string through the upper sealing element and the lower sealing element;

a source of inert liquid connected to supply inert liquid to the snubbing stack between the upper sealing element and the lower sealing element; and a pressure sensor connected to sense the wellbore pressure below the lower sealing element and connected to provide a pressure signal to the source of inert liquid, the source of inert liquid being configured to pressurize the inert liquid in the snubbing stack between the upper sealing element and the lower sealing element in response to the pressure signal.

2. The snubbing apparatus of claim 1, wherein the source of inert liquid is configured to equalize the pressure between the upper sealing element and the lower sealing element to the wellbore pressure below the lower sealing element.

3. The snubbing apparatus of claim 1, further comprising a bleed off valve connected to the snubbing stack between the upper sealing element and the lower sealing element.

4. The snubbing apparatus of claim 1, the snubbing stack comprising a tubing spool that extends below the lower sealing element, the pressure sensor being connected to the tubing spool.

5. The snubbing apparatus of claim 1, wherein the tubing string driver is snubbing slips.

6. The snubbing apparatus of claim 1, wherein the upper sealing element is an annular blowout preventer.

7. The snubbing apparatus of claim 1, wherein the lower sealing element is a resilient sealing element.

8. The snubbing apparatus of claim 1, wherein the lower sealing element is within a tubing spool.

9. The snubbing apparatus of claim 1, further comprising a bleed off valve connected below the lower sealing element.

10. The snubbing apparatus of claim 1, wherein the source of inert liquid is a liquid pump.

11. The snubbing apparatus of claim 1, wherein the inert liquid is glycol.

12. A method of snubbing an elongate string into a wellbore having a wellhead, the method comprising the steps of:

providing a snubbing stack having an upper sealing element and a lower sealing element, the lower sealing element sealing between the snubbing stack and a wellhead pressure below the lower sealing element;

inserting the elongate string into the snubbing stack such that the top and lower sealing elements seal between the elongate string and the snubbing stack;

driving the elongate string to move through the upper sealing element and the lower sealing element;

sensing the wellhead pressure below the lower sealing element;

injecting an inert fluid into the snubbing stack; and pressurizing the inert fluid within the snubbing stack based on the wellhead pressure.

13. The method of claim 12, wherein pressurizing the inert fluid comprises equalizing the pressure to the wellhead pressure.

14. The method of claim 12, wherein injecting an inert fluid into the snubbing stack further comprises bleeding off fluid within the snubbing stack as the inert fluid is injected.

15. The method of claim 12, wherein the snubbing stack comprises a spool that extends below the lower sealing element and the wellhead pressure is measured by a pressure sensor connected to the spool.

16. The method of claim 12, wherein driving the elongate string comprises using snubbing slips.

17. The method of claim 12, wherein the upper sealing element is an annular blowout preventer.

18. The method of claim 12, wherein the lower sealing element is a resilient sealing element.

19. The method of claim 12, wherein the lower sealing element is within a spool.

20. The method of claim 12, wherein the inert liquid is pressurized by a liquid pump connected to a source of inert liquid.

21. The method of claim 12, wherein the inert liquid is glycol.

* * * * *